United States Patent [19]

Stolka et al.

[11] Patent Number: 4,774,159

[45] **Date of Patent: * Sep. 27, 1988**

[54] PHOTORESPONSIVE IMAGING MEMBERS WITH OXYGENATED POLYSILYLENES

[75] Inventors: Milan Stolka, Fairport; Frederick J. Roberts, Jr., Webster; Ronald J. Weagley, Penfield; Santokh S. Badesha, Pittsford; Kathleen M. McGrane, Rochester, all of N.Y.

[73] Assignee: Xerox Corporation, Stamford, Conn.

[ * ] Notice: The portion of the term of this patent subsequent to Oct. 22, 2003 has been disclaimed.

[21] Appl. No.: 133,591

[22] Filed: Dec. 14, 1987

[51] Int. Cl.[4] ..... G03G 5/10

[52] U.S. Cl. ..... 430/58; 430/60; 430/62; 430/63

[58] Field of Search ..... 430/58, 60, 62, 63

[56] References Cited

U.S. PATENT DOCUMENTS 4,544,729 10/1985 Nate et al. ..... 528/28

4,618,551 10/1986 Stolka et al. ..... 430/58

*Primary Examiner*—John L. Goodrow

*Attorney, Agent, or Firm*—E. O. Palazzo

[57] ABSTRACT

An imaging member in accordance with claim 1 wherein the oxygenated polysilylene is of the formula wherein $R_1$, $R_2$, $R_3$, $R_4$, $R_5$, $R_6$, $R_7$ and $R_8$ are independently selected from the group consisting of alkyl, aryl, substituted alkyl, and substituted aryl, and alkoxy; m is from 0 to 0.98 mole percent; n is from 0 to 0.98 mole percent; p is from 0 to 0.98 mole percent; q is from 0.02 to 0.12 mole percent subject to the provisions that the sum of m+n+p is less than or equal to 0.98; and the sum of m+n+p+q is equal to 1.

23 Claims, 1 Drawing Sheet

PHOTORESPONSIVE IMAGING MEMBERS WITH OXYGENATED POLYSILYLENES

BACKGROUND OF THE INVENTION

This invention is generally directed to imaging members with polysilylenes therein, and more specifically the present invention is directed to photoresponsive imaging members containing as hole transporting substances oxygenated polysilylene compositions. In one important embodiment of the present invention there is provided a layered photoresponsive imaging member comprised of an oxygenated polysilylene hole transporting compound and a photogenerating layer. Further, there is provided in another aspect of the present invention an improved layered photoresponsive imaging member comprised of a supporting substrate, a photogenerating layer, and in contact therewith a hole transport layer comprised of oxygenated polysilylenes; and wherein the photogenerating pigment is dispersed in an oxygenated polysilylene selected for the hole transport layer. In addition, there is provided in accordance with the present invention an improved photoresponsive imaging member comprised of a supporting substrate, a photogenerating layer comprised of a photogenerating pigment dispersed in a polysilylene composition, and a hole transport layer comprised of an oxygenated polysilylene. The layer with the oxygenated polysilylene hole transporting compound can be located as the top layer of the imaging member, or alternatively it may be situated between the supporting substrate and the photogenerating layer. With further respect to the present invention, the imaging members are particularly useful in electrophotographic, and especially xerographic imaging processes, particularly those wherein development is accomplished with dry or liquid developer compositions.

Photoresponsive imaging members containing therein, for example, polysilylenes as hole transporting components are disclosed in U.S. Pat. No. 4,618,551, the disclosure of which is totally incorporated herein by reference. More specifically, there is illustrated in this patent a polysilylene hole transporting compound for use in layered imaging members wherein the polysilylene is of the formula as illustrated in claim 1, for example, and wherein the substituents $R_1$, $R_2$, $R_3$, $R_4$, $R_5$ and $R_6$ are independently selected from a group consisting of alkyl, aryl, substituted alkyl, substituted aryl and alkoxy; and n, m and p are numbers that represent the percentage of the monomer unit and the total polymer compound. There are also illustrated in the aforementioned patent layered photoresponsive imaging members which are useful in electrophotographic imaging apparatuses wherein development is accomplished with liquid inks, which member is comprised of a supporting substrate, a photogenerating layer, and a polysilylene hole transporting layer, wherein the polysilylenes are of the formulas as recited, for example, in claim 1. This patent also discloses that the hole transporting polysilylenes may be useful as binder polymers for photogenerating substances comprised of organic materials, and furthermore details in FIG. 3 a negatively charged photoresponsive imaging member comprised of a conductive supporting substrate, an optional adhesive blocking layer, a photogenerating layer dispersed in a polysilylene resinous binder, and a hole transporting layer comprised of a poly(methyl phenyl silylene). Also of interest is U.S. Pat. No. 4,544,729 which discloses photo and radiation sensitive organo polymeric materials which have at least one unit represented by the general formula as illustrated in column 2, beginning at line 15, which formula includes therein silicon components. Other patents that are of background interest in that, for example, they illustrate layered photoresponsive imaging members containing various hole transporting substances such as aryl amines include U.S. Pat. Nos. 4,265,990; 4,251,612; 4,115,116; 4,047,949; and 4,081,274.

Although the above described imaging members are useful for their intended purposes, there remains a need for improved members. More specifically, there remains a need for imaging members wherein there are selected oxygenated polysilylenes thereby enabling, for example, their usefulness in electrophotographic imaging apparatuses wherein liquid developers are selected. Also, there is a need for economical imaging members wherein there is selected for the photogenerating pigment binder of the same component as selected for the hole transporting layer. There is also a need for new hole transporting components that are useful in layered imaging members, which members are flexible, and wherein the binders for the photogenerating pigments are not small molecules such as illustrated in U.S. Pat. No. 4,265,990, the disclosure of which is totally incorporated herein by reference, but rather are high molecular weight polysilylenes which are compatible with, for example, liquid developers. Additionally, there is a need for imaging members wherein the layers possess improved adhesion characteristics in some embodiments, and are flexible.

SUMMARY OF THE INVENTION

It is an object of the present invention to provide improved photoresponsive imaging members with new hole transporting components.

In another object of the present invention there are provided layered photoresponsive imaging members containing therein oxygenated polysilylene hole transporting substances.

Furthermore, in another object of the present invention there are provided layered imaging members with a photogenerating layer situated between a supporting substrate and a hole transport layer comprised of oxygenated polysilylenes disclosed hereinafter.

In addition, a further object of the present invention resides in the provision of improved photoresponsive imaging members comprised of oxygenated, about 1 to about 10 percent of oxygen, polysilylene hole transporting compound layers situated between a supporting substrate and a photogenerating layer of layers.

In still yet another object of the present invention there are provided improved photoresponsive imaging members comprised of hole transporting oxygenated polysilylenes, photogenerating layers, and protective overcoatings.

Furthermore, another object of the present invention resides in the provision of imaging member which are particularly useful in electrophotographic apparatuses wherein liquid developer compositions are selected, which members are comprised of a photogenerating pigment dispersed in an oxygenated polysilylene and an oxygenated polysilylene hole transporting component.

Another object of the present invention resides in the provision of layered imaging members comprised of hole transporting oxygenated polysilylene compounds that enable improved insulating characteristics in the dark for the resulting member thus allowing charging in higher fields while maintaining cyclic stability and improved developability.

Also, another object of the present invention resides in the provision of layered imaging members with improved stability thus undersirably avoiding the extraction of the binder selected for the photogenerating pigment with, for example, liquid developer compositions.

Additionally, another object of the present invention resides in the provision of layered imaging members with oxygenated, from about 1 to about 10 percent by weight of oxygen, polysilylenes which imaging members possess increased flexibility and substantially no cracking subsequent to repeated imaging cycles in electrophotographic imaging apparatuses.

These and other objects of the present invention are accomplished by the provision of hole transporting compositions comprised of oxygenated polysilylenes. More specifically, the present invention is directed to an improved photoresponsive imaging member comprised of a photogenerating layer, and in contact therewith a hole transporting layer comprised of oxygenated polysilylene compositions.

In one specified embodiment of the present invention there is provided an improved photoresponsive imaging member comprised of a supporting substrate, a photogenerating layer comprised of inorganic or organic photoconductive pigments optionally dispersed in an oxygenated polysilylene resinous binder, and in contact therewith an oxygenated polysilylene hole transporting compound. Another specific photoresponsive imaging member of the present invention is comprised of an oxygenated polysilylene hole transporting layer situated between a supporting substrate and the photogenerating layer.

The oxygenated polysilylene hole tranporting compounds of the present invention include generally polymers, especially homopolymers, copolymers or terpolymers of the following formula

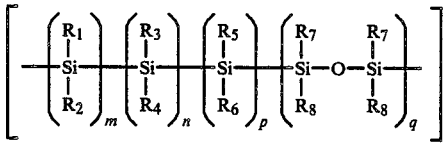

wherein $R_1$, $R_2$, $R_3$, $R_4$, $R_5$, $R_6$, $R_7$ and $R_8$ are independently selected from the group consisting of alkyl, aryl, substituted alkyl, substituted aryl, and alkoxy; m is from 0 to 0.98 mole percent; n is from 0 to 0.98 mole percent; p is from 0 to 0.98 mole percent; q is from 0.02 to 0.12 mole percent subject to the provisions that the sum of m+n+p is less than or equal to 0.98; and the sum of m+n+p+q is equal to 1. Preferred are oxygenated polysilylenes containing therein from about 1 to about 10 percent by weight of oxygen in the backbone of the polymer. Any of the monomer units of the polysilylene can be randomly distributed throughout the polymer, or may alternatively be in blocks of varying lengths.

Examples of alkyl groups include those that are linear, or branched of from 1 carbon atom to about 24 carbon atoms, and preferably from about 1 carbon atom to about 8 carbon atoms, inclusive of methyl, ethyl, propyl, butyl, amyl, hexyl, octyl, nonyl, decyl, pentadecyl, stearyl; and unsaturated alkyls inclusive of allyls, and other similar substituents. Specific preferred alkyl groups are methyl, ethyl, propyl and butyl. Aryl substituents include those of from 6 carbon atoms to about 24 carbon atoms, inclusive of phenyl, naphthyl, anthryl, and the like. These alkyl and aryl groups may be substituted with alkyl, aryl, halogen, nitro, amino, alkoxy, cyano, and other related substituents. Examples of alkoxy groups include those with from 1 carbon atom to about 10 carbon atoms, such as methoxy, ethoxy, propoxy, butoxy, and other similar substituents.

Of importance with respect to the polysilylenes selected for the present invention is the percentage of oxygen present therein. Generally, this percentage ranges from about 1 to about 20 percent, and is preferably from about 1 to about 10 percent of the polysilylene. Additionally, the weight average molecular weight of the oxygenated polysilylene selected for the invention of the present application can vary depending on a number of parameters and their intended use. Generally, however, this molecular weight is in excess of 10,000, and is preferably of a weight average molecular weight of from about 75,000 to about 1,000,000. Similarly, oxygenated polysilylenes of the general formula illustrated hereinbefore can be of a weight average molecular weight of up to 2,000,000. Preferred are oxygenated polysilylenes with a weight average molecular weight of from about 10,000 to about 500,000.

The improved photoresponsive imaging members of the present invention can be prepared by a number of known methods, the process parameters, and the order of the coating of the layers being dependent on the member desired. Thus, for example, the improved photoresponsive members of the present invention can be prepared by providing a conductive substrate with an optional hole blocking layer and an optional adhesive layer; and applying thereto by solvent coating processes, laminating processes, or other methods a photogenerating layer and the polysilylene hole transport layer. Other methods include melt extrusion, dip coating, and spraying.

BRIEF DESCRIPTION OF THE DRAWINGS

For a better understanding of the present invention and further features thereof, reference is made to the following detailed description of various embodiments wherein.

As overcoatings for these members, there can be selected an aryl amine dispersed in a resin binder, inclusive of polycarbonates containing carbon black. The carbon black is usually present in various amounts, however, from about 5 percent to about 15 percent of carbon black is preferred.

DESCRIPTION OF THE PREFERRED EMBODIMENTS

Figure 1:
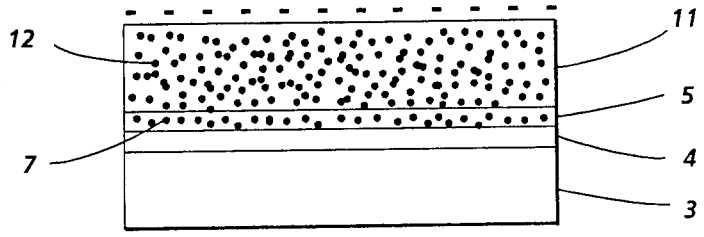
FIG. 1 is a partially schematic cross-sectional view of the improved photoresponsive imaging member of the present invention.

Illustrated in FIG. 1 is a negatively charged improved photoresponsive imaging member of the present invention comprised of a supporting substrate 3, an optional adhesive blocking layer 4, a charge carrier photogenerating layer 5 comprised of a photogenerating pigment 7, and hole transport layer 11 comprised of an oxygenated polysilylene hole transporting compound 12 with from about 2 to about 10 percent by weight of oxygen. In an alternative embodiment of the present invention, and with further regard to FIG. 1, the hole transporting layer can be situated between the supporting substrate and the photogenerating layer resulting in a positively charged imaging member.

Figure 2:
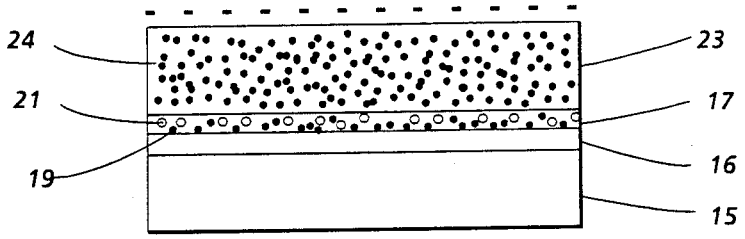
FIG. 2 represents a partially schematic cross-sectional view of a photoresponsive imaging member of the present invention.

Illustrated in FIG. 2 is a negatively charged photoresponsive imaging member of the present invention comprised of a conductive supporting substrate 15 of aluminized Mylar, an optional adhesive blocking layer 16, a photogenerating layer 17 comprised of a trigonal selenium photogenerating pigment 19, or other similar inorganic photogenerating pigments as well as organic pigments optionally dispersed in the oxygenated polysilylene resinous binder 21, and a hole transport layer 23 comprised of the oxygenated polysilylene 24 obtained by the process of Example 1.

Figure 3:
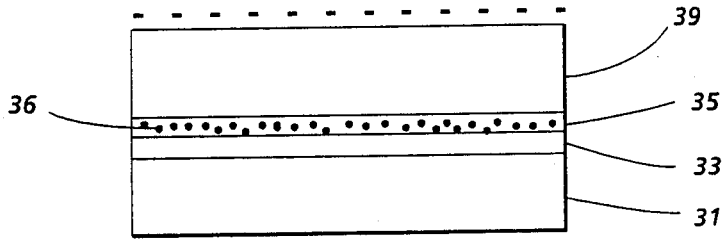
FIG. 3 represents a partially schematic cross-sectional view of the photoresponsive imaging member of the present invention including therein an optional blocking adhesive layer.

Illustrated in FIG. 3 is a negatively charged photoresponsive imaging member of the present invention comprised of a conductive supporting substrate 31 of aluminized Mylar; an optional adhesive blocking layer 33; a photogenerating layer 35 comprised of an inorganic or organic photogenerating pigment 36, inclusive of trigonal selenium, vanadyl phthalocyanine, metal phthalocyanines, metal free phthalocyanines, and cadmium-sulfur-selenide; and a hole transport layer 39 comprised of the oxygenated poly(methylphenyl silylene) obtained by the process of Example II.

Figure 4:
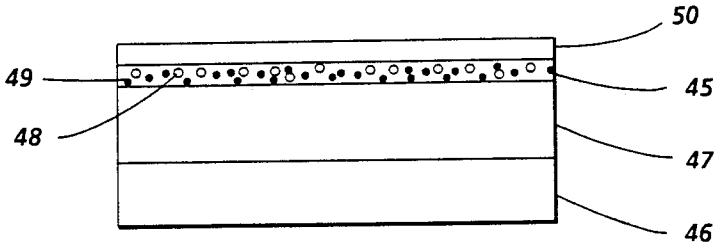
FIG. 4 represents a partially schematic cross-sectional view of the photoresponsive imaging member of the present invention wherein the polysilylene hole transporting compound is situated between a supporting substrate and a photogenerating layer.

Illustrated in FIG. 4 is a positively charged photoresponsive imaging member of the present invention comprised of a conductive supporting substrate 45 of aluminized Mylar, a hole transporting layer 47 comprised of oxygenated poly(methylphenyl silylene) with 5 percent of oxygen, reference the product of Example II, a photogenerating layer 45 comprised of inorgaic or organic photogenerating pigment 49 inclusive of amorphous selenium, trigonal selenium, vanadyl phthalocyanine, metal free phthalocyanine, metal phthalocyanines, cadmium-sulfur-selenide opionally dispersed in an oxygenated poly(methylphenyl silylene) binder 48, reference the product of Example II, or nonoxygenated polysilylenes, reference U.S. Pat. No. 4,618,551, the disclosure of which is totally incorporated herein by reference; and a protective overcoating layer 50.

The supporting substrate layers may be opaque or substantially transparent and may comprise any suitable material having the requisite mechanical properties. Thus, these substrates may comprises a layer of nonconducting material such as an inorganic or organic polymeric material, a layer of an organic or inorganic material having a conductive surface layer arranged thereon or a conductive material such as, for example, aluminum, chromium, nickel, indium, tin oxide, brass or the like. The substrate may be flexible or rigid and may have any of many different configurations such as, for example, a plate, a cylindrical drum, a scroll, an endless flexible belt and the like. Preferably, the substrate is in the form of an endless flexible belt.

The thickness of the substrate layer depends on many factors including economical considerations. Thus, this layer may be of substantial thickness, for example over 100 mils or minimum thickness, providing the objectives of the present invention are achievable. In one preferred embodiment, the thickness of this layer ranges from about 3 mils to about 10 mils.

Examples of the photogenerating pigments are as illustrated herein, inclusive of amorphous selenium, selenium alloys, such as $As_2Se_3$, trigonal selenium metal free phthalocyanines, metal phthalocyanines, vanadyl phthalocyanines, squaraines, and the like with $As_2Se_3$ being preferred. Typically, this layer is of a thickness of from about 0.3 micron to about 10 microns or more in thickness, however, dependent on the photoconductive volume loading, which may vary from 5 to 100 volume percent, this layer can be of other thicknesses. Generally, it is desirable to provide this layer in a thickness which is sufficient to absorb about 90 percent or more of the incident radiation which is directed upon it in the imagewise exposure step. The maximum thickness of this layer is dependent primarily upon facts such as mechanical considerations, for example whether a flexible photoresponsive imaging member is desired.

There can be selected as the optional resinous binder for the photogenerating pigments mentioned herein the oxygenated polysilylenes of the formula illustrated hereinbefore, and other known binders. Accordingly, there can be selected for the photogenerating pigment binder the polymers illustrated in U.S. Pat. No. 3,121,006, the disclosure of which is totally incorporated herein by reference, such as polyesters, polyvinyl butyrals, and polyvinyl carbazoles, which binders are generally no compatible with liquid developers; and the oxygenated polysilylenes illustrated herein, which binders are compatible with liquid developers, and possess other advantages.

The same oxygenated polysilylenes which may be selected for the binder for the photogenerating pigment are also selected as the hole transporting component, however, it is to be appreciated that these organopolysilylenes may not be identical in their composition and/or molecular weight. Thus, there can be selected as the binder for the photogenerating pigment an oxygenated polysilylene different in composition and molecular weight than the oxygenated polysilylene selected for the hole transporting component, however, it is preferred that the oxygenated polysilylene selected as the binder for the photogenerating pigment and as the hole transporting component be substantially identical.

The oxygenated polysilylenes illustrated herein are generally prepared as detailed in the prior art, such as U.S. Pat. No. 4,618,551, the disclosure of which is totally incorporated herein by reference, with the exception that there is included a source of oxygen as a reaction component. Thus, for example, the oxygenated polysilylenes illustrated herein can be obtained by the reaction of the appropriate alkyl aryl dihalo silylene with a dihalo dialkyl diaryl disiloxane in the presence of a polymerization initiator, and with heating in a suitable solvent such as toluene. Thereafter, the polymer solution resulting is separated from the reactoin byproducts by filtration of the reaction mixture, and isolation of the desired polymer product is accomplished by precipitating the separated polymer solution into a nonsolvent for the polymer such as, for example, an acetone hexane mixture, isopropanol-acetone mixture, and the like. The resulting products are characterized by DSC (differential scanning calorimetry), infrared, FTIR for the determination of the oxygen, and NMR for detailed structure identification.

With further respect to the present invention, the oxygenated polysilylenes may also be selected as protective overcoating coatings for photoconductor imaging members including amorphous selenium, selenium alloys, layered members containing selenium arsenic alloys as the top layer, reference U.S. Ser. No. 487,935, the disclosure of which is totally incorporated herein by reference; and layered imaging members comprised of a photogenerating layer and a diamine hole transport layer, reference U.S. Pat. No. 4,265,990 referred to hereinbefore. In this embodiment, the polysilylenes are applied as an overcoating to the imaging member in a thickness of from about 0.5 micron to about 7.0 microns, and preferably from about 1.0 micron to about 4.0 microns. Moreover, as indicated herein the polysilylene compositions of the present invention can be selected as resinous binders for the imaging members described herein, including inorganic and organic photogenerators such as trigonal selenium, selenium alloys, hydrogenated amorphous silicon, silicon-germanium alloys, and vanadyl phthalocyanine. Thus, for example, the imaging member in one embodiment is comprised of a supporting substrate, a photogenerating layer comprised of a photogenerating pigment of trigonal selenium, or vanadyl phthalocyanine dispersed in the polysilylenes composition, which are now functioning as a resinous binder; and as a top layer an aryl amine hole transport composition, reference the 990 patent mentioned herein, or polysilylenes.

Further, the polysilylene compositions of the present invention may also function as interface layers. As interface layers, the polysilylenes are applied between, for example, a supporting substrate and the photogenerating layer, or the photogenerating layer and the hole transport layer; and wherein these polymers provide improved adhesion of the respect layers. Other interface layers useful for the imaging members of the present invention include, for example, polyesters and similar equivalent materials. These adhesive layers are of a thickness of from about 0.05 micron to about 2 microns.

The imaging members of the present invention are useful in various electrophotographic imaging systems, especially xerographic systems, wherein an electrostatic image is formed on the photoresponsive imaging member, followed by the development thereof, transfer to a suitable substrate, and fixing of the resultant image.

The invention will now be described in detail with respect to specific preferred embodiments thereof, it being understood that these examples are intended to be illustrative only. The invention is not intended to be limited to the materials, conditions, process parameters, etc. recited herein. All parts and percentages are by weight unless otherwise indicated.

EXAMPLE I ($R_1$ and $R_7$ are methyl; $R_2$ and $R_8$ are phenyl; n is equal to p which equal 0 (zero) mole percent)

There was prepared the aforementioned oxygenated polysilylene with 2 percent of oxygen in the backbone, and wherein m was 0.98 mole percent and q was 0.02 mole percent by reacting 17.9 grams of methylphenyl dichlorosilylene in 0.65 gram of 1,3-dichloro-1,3-dimethyl-1,3-diphenyl disiloxane with a sodium dispersion, 4.4 grams of sodium, and refluxing toluene under and inert atmosphere. Polymerization occurred within about 2 to 4 hours, and subsequently the polymer solution resulting was separated from the reaction byproducts by filtration of the reaction mixture. Isolation of the above oxygenated polysilylene product was accomplished by precipitation of the polymer solution into an acetone hexane (3:2) nonsolvent for the polymer, and wherein 10 parts of the solvent per 1 part of polymer solution were selected. The product was obtained in a yield of about 10 to 15 percent, and the molecular weight thereof as determined by GPC (gel permeation chromatography) was 10,000 to 500,000. The polymer was also identified by NMR, FTIR, and DSC analysis.

EXAMPLE II

An oxygenated polysilylene polymer with 5 mole percent of oxygen in the backbone, and wherein m was 0.94 and q was 0.06, was prepared by reacting 16.24 grams of methylphenyl dichlorosilylene and 1.64 grams of 1,3-dichloro-1,3-dimethyl-1,3-diphenyl disiloxane by repeating the procedure of Example I. There resulted a polysilylene product wherein n was 0.94 and q was 0.06 in the formula illustrated herein, which polysilylene had a weight average molecular weight of from about 10,000 to about 500,000. This polymer product was also identified in accordance with the procedure of Example I.

EXAMPLE III

An oxygenated polysilylene polymer with 10 mole percent of oxygen in the backbone, and wherein m was 0.88 and q was 0.12, was prepared by repeating the procedure of Example I with the exception that there was selected 13.4 grams of methylphenyl dischlorosilylene, and 3.27 grams of 1,3-dichloro-1,3-dimethyl-1,3-diphenyl disiloxane, and substantially similar results were obtained with the exception that the polysilylene was of the formula as illustrated with respect to Example I and wherein m was 0.88 and q was 0.12, and there was present 10 percent by weight of oxygen in the backbone.

EXAMPLE IV

There is prepared an oxygenated polysilylene with 2 mole percent of oxygen of the formula illustrated herein wherein $R_1$ and $R_7$ are methyl, $R_2$ is n-propyl, $R_8$ is phenyl, m is 0.98 and q is 0.02 with n and p being equal to 0 mole percent. This is accomplished by repeating the procedure of Example I with the exception that there is selected 14.7 grams of methyl-propyl dichlorosilylene and 0.65 gram of 1,3-dichloro-1,3-dimethyl-1,3-diphenyl disiloxane.

EXAMPLE V

A polysilylene is prepared by repeating the procedure of Example IV with the exception that m=0.94 and q=0.06, and there results 5 mole percent of oxygen in the backbone with the exception that there is selected 13.4 grams of methyl-n-propyl-dichlorosilylene, and 1.64 grams of 1,3-dichloro-1,3-dimethyl-1,3-diphenyl disiloxane.

EXAMPLE VI

An oxygenated polysilylene with 10 mole percent of oxygen in the backgone is prepared by repeating the procedure of Example IV with the exception that m=0.88 and q=0.12, and wherein there is reacted 11.0 grams of methyl-n-propyl dichlorosilylene, and 3.27 grams of 1,3-dichloro-1,3-dimethyl-1,3-diphenyl disiloxane.

EXAMPLE VII

An oxygenated polysilylene of the formula illustrated herein is prepared with 5 mole percent of oxygen in the polymer backbone and wherein $R_1$, $R_3$ and $R_7$ are methyl; $R_2$ is phenyl; $R_4$ is n-propyl; $R_8$ is phenyl; m is 0.55 mole percent; n is 0.39 mole present; and q is 0.06 mole percent by reacting 10.5 grams of methylphenyl dichlorosilylene, 6.13 grams of methyl-n-propyl-dichlorosilylene, and 1.9 grams of 1,3-dichloro-1,3-dimethyl-1,3-diphenyl disiloxane with 4.4 grams of sodium metal. The reaction is accomplished by repeating the procedure of Example I and substantially similar results can be obtained.

EXAMPLE VIII

An oxygenated polysilylene with 10 mole percent of oxygen in the backbone is prepared by repeating the procedure of Example VII with the exception that there is selected 10.5 grams of methylphenyl dichlorosilylene, 2.4 grams of methyl-n-propyl dichlorosilylene, and 3.27 grams of 1,3-dichloro-1,3-dimethyl-1,3-diphenyl disiloxane; and there results an oxygenated polysilylene wherein m is 0.55, n is 0.15, and q is 0.10.

EXAMPLE IX

There is prepared a polysilylene with 2 mole percent of oxygen in the backbone, and wherein m is 0.31, n is 0.67, and q is 0.02 by repeating the procedure of Example VIII with the exception that there is selected 5.9 grams of methylphenyl dichlorosilylene, 10.5 grams of methyl-n-propyl dichlorosilylene, and 0.6 gram of 1,3-dichloro-1,3-dimethyl-1,3-diphenyl disiloxane.

EXAMPLE X

There is prepared a polysilylene with 5 mole percent of oxygen in the backbone, and wherein m is 0.33 mole percent, n is 0.61 mole percent, and q is 0.06 mole percent by repeating the procedure of Example VIII with the exception that there is selected 6.3 grams of methylphenyl dichlorosilylene, 9.6 grams of methyl-n-propyl dichlorosilylene, and 1.96 grams of 1,3-dichloro-1,3-dimethyl-1,3-diphenyl disiloxane.

EXAMPLE XI

There is prepared a polysilylene with 2 mole percent of oxygen in the backbone, and wherein m is 0.49 mole percent, n is 0.49 mole percent, and q is 0.02 mole percent, and $R_1$ and $R_3$ are methyl, $R_2$, $R_7$, and $R_8$ are phenyl, and $R_4$ is propyl, by repeating the procedure of Example VIII with the exception that there is selected 9.4 grams of methylphenyl dichlorosilylene, 7.7 grams of methyl-n-propyl dichlorosilylene, and 0.002 mole of disiloxane.

EXAMPLE XII

There is prepared a polysilylene with 10 mole percent of oxygen in the backbone, and wherein m is 0.44 mole percent, n is 0.44 mole percent, and q is 0.12 mole percent by repeating the procedure of Example XI with the exception that there is selected 8.43 grams of methylphenyl dichlorosilylene, 6.9 grams of methyl-n-propyl dichlorosilylene, and 5.4 grams of 1,3-dichloro-1,3-dimethyl-1,3-diphenyl disiloxane.

EXAMPLE XIII

There is prepared a polysilylene with 5 mole percent of oxygen in the backbone, and wherein m is 0.39 mole percent, n is 0.45 mole percent, and q is 0.06 mole percent by repeating the procedure of Example XII with the exception that there is selected 87.5 grams of methylphenyl dichlorosilylene, 7.1 grams of methyl-n-propyl dichlorosilylene, and 2.7 grams of 1,3-dichlorotetraphenyl disiloxane.

EXAMPLE XIV

There is prepared a polysilylene with 5 mole percent of oxygen in the backbone, and wherein m is 0.33 mole percent, n is 0.33 mole percent, p is 0.28 mole percent, and q is 0.06 mole percent; and $R_1$ and $R_7$ are phenyl, $R_2$, $R_3$, $R_6$ and $R_8$ are methyl, $R_5$ is cyclohexyl, and $R_4$ is n-propyl by repeating the procedure of Example I with the exception that there is selected 6.3 grams of methylphenyl dichlorosilylene, 5.2 grams of methyl-n-propyl dichlorosilylene, 5.2 grams of methyl cyclohexyl dichlorosilylene, and 1.96 grams of 1,3-dichloro-1,3-dimethyl-1,3-diphenyl disiloxane.

EXAMPLE XV

There is prepared a polysilylene with 2 mole percent of oxygen in the backbone, and wherein m is 0.52 mole percent, n is 0.21 mole percent, p is 0.25 mole percent, and q is 0.02 mole percent by repeating the procedure of Example IX with the exception that there is selected 9.97 grams of methylphenyl dichlorosilylene, 3.3 grams of methyl-n-propyl dichlorosilylene, 4.9 grams of methyl cyclohexyl dichlorosilylene, and 6.5 grams of 1,3-dichloro-1,3-dimethyl-1,3-diphenyl disiloxane.

EXAMPLE XVI

There is prepared a polysilylene with 10 mole percent of oxygen in the backbone, and wherein m is 0.12 mole percent, n is 0.25 mole percent, p is 0.50 mole percent, and q is 0.125 mole percent by repeating the procedure of Example X with the exception that there is selected 2.3 grams of methylphenyl dichlorosilylene, 3.9 grams of methyl-n-propyl dichlorosilylene, 9.9 grams of methyl cyclohexyl dichlorosilylene, and 4.1 grams of 1,3-dichloro-1,3-dimethyl-1,3-diphenyl disiloxane.

EXAMPLE XVII

There is prepared a polysilylene with 5 mole percent of oxygen in the backbone, and wherein $R_3$, $R_5$ and $R_6$ are ethyl, $R_1$, $R_4$, $R_7$ and $R_8$ are phenyl, and $R_2$ is methyl; and wherein m is 0.33 mole percent, n is 0.33 mole percent, p is 0.28 mole percent, and q is 0.06 mole percent by repeating the procedure of Example I with the exception that there is selected 6.36 grams of methylphenyl dichlorosilylene, 6.9 grams of ethyl phenyl dichlorosilylene, 4.4 grams of diethyl dichlorosilylene, and 2.7 grams of 1,3-dichlorotetraphenyl disiloxane.

EXAMPLE XVIII

A photoresponsive imaging member was prepared by providing an aluminized Mylar substrate in a thickness of 3 mils followed by applying thereto with a multiple clearance film applicator in a wet thickness of 0.5 mils a layer of 3-amino propyl triethoxy silane available from PCR Research Chemicals of Florida in ethanol in a 1:50 volume ratio. This layer was then allowed to dry for 5 minutes at room temperature, followed by curing for 10 minutes at 110° C. in a forced air oven. A photogenerating layer of amorphous selenium in a thickness of 0.5 micron was then applied to the silane layer. Thereafter, the amorphous selenium photogenerating layer formed was overcoated with the oxygenated polysilylene layer obtained from Example I from a solution of toluene and tetrahydrofuran, volume ratio of 2:1, this disposition being affected by spraying. There resulted after drying a charge transport layer of 15 microns in thickness.

Electrostatic latent images are then generated on the above prepared imaging member subsequent to its incorporation into a xerographic imaging laboratory test fixture, and after charging the member to a negative voltage of 700 volts. Thereafter, the resulting images were developed with a toner composition comprised of 92 percent by weight of a styrene n-butyl methacrylate copolymer (58/42), 8 percent by weight of carbon black particles, and 2 percent by weight of the charge enhancing additive cetyl pyridinium chloride. There resulted as determined by visual observation developed images of excellent resolution and superior quality for 10,000 imaging cycles.

Other imaging members can be prepared with the oxygenated polysilylenes of the present invention by repeating the procedure of Example XIII, and further the imaging members as illustrated in U.S. Pat. No. 4,618,551, the disclosure of which is totally incorporated herein by reference, can also be prepared with the exception that there are selected as the hole transport layer the oxygenated polysilylenes of the present invention.

Although the invention has been described with reference to specific preferred embodiments, it is not intended to be limited thereto; rather, those skilled in the art will recognize variations, and modifications may be made therein which are within the spirit of the invention and within the scope of the following claims.

What is claimed is:

1. An imaging member comprised of a supporting substrate, a photogenerating layer, and an oxygenated polysilylene hole transporting layer.

2. An imaging member in accordance with claim 1 wherein the oxygenated polysilylene is of the formula

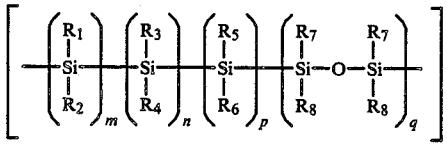

wherein $R_1$, $R_2$, $R_3$, $R_4$, $R_5$, $R_6$, $R_7$ and $R_8$ are independently selected from the group consisting of alkyl, aryl, substituted alkyl, substituted aryl, and alkoxy; m is from 0 to 0.98 mole percent; n is from 0 to 0.98 mole percent; p is from 0 to 0.98 mole percent; q is from 0.02 to 0.12 mole percent subject to the provisions that the sum of m+n+p is less than or equal to 0.98; and the sum of m+n+p+q is equal to 1.

3. An imaging member in accordance wtih claim 2 wherein the R substituents are selected from linear and branched alkyl groups.

4. An imaging member in accordance with claim 2 wherein n and p are zero, m is 0.98, and q is 0.02.

5. An imaging member in accordance with claim 2 wherein the alkyl substituents are from 1 to about 10 carbon atoms, and the aryl substituents are from 6 to about 24 carbon atoms.

6. An imaging member in accordance with claim 5 wherein alkyl is methyl.

7. An imaging member in accordance wtih claim 5 wherein aryl is phenyl.

8. An imaging member in accordance with claim 1 wherein the weight average molecular weight of the polysilylene hole transporting substance is in excess of 10,000.

9. An imaging member in accordance with claim 8 wherein the weight average molecular weight of the polysilylene hole transporting compound is from about 75,000 to about 1,000,000.

10. An imaging member in accordance with claim 1 wherein the oxygenated polysilylene contains from about 1 to about 10 mole percent of oxygen.

11. An imaging member in accordance with claim 2 wherein n and p are zero.

12. An imaging member in accordance with claim 2 wherein m is equal to 0.98 and q is equal to 0.02.

13. A process of generating developed electrostatic latent images which comprises providing the imaging member of claim 1, forming thereon an electrostatic latent image, thereafter accomplishing development of this image, subsequently transferring the developed image to a suitable substrate, and permanently affixing the image thereto.

14. A process in accordance with claim 13 wherein the oxygenated polysilylene is of the formula of claim 2.

15. A process in accordance with claim 13 wherein development is accomplished with a liquid ink composition.

16. An imaging member in accordance with claim 1 containing a protective overcoating.

17. An imaging member in accordance with claim 2 wherein m is 0.94 mole percent, q is 0.06 mole percent, n is 0 mole percent, p is 0 mole percent, $R_1$ is methyl, $R_7$ is methyl, $R_2$ is phenyl, and $R_8$ is phenyl.

18. An imaging member in accordance with claim 2 wherein m is 0.88 mole percent, q is 0.12 mole percent, n is 0 mole percent, p is 0 mole percent, $R_1$ and $R_7$ are methyl, and $R_2$ and $R_8$ are phenyl.

19. An imaging member in accordance with claim 2 wherein $R_1$ and $R_7$ are methyl, $R_2$ is propyl, $R_8$ is phenyl, m is 0.98 mole percent, q is 0.02 mole percent, n is 0 mole percent, and p is 0 mole percent.

20. An imaging member in accordance with claim 2 wherein $R_1$, $R_3$ and $R_7$ are methyl, $R_2$ is phenyl, $R_4$ is propyl, $R_8$ is phenyl, m is 0.55 mole percent, q is 0.06 mole percent, n is 0.39 mole percent, and p is 0 mole percent.

21. An imaging member in accordance with claim 2 wherein $R_1$ and $R_3$ are methyl, $R_2$, $R_7$ and $R_8$ are phenyl, $R_4$ is propyl, n is 0.49 mole percent, m is 0.49 mole percent, q is 0.02 mole percent, and p is 0 mole percent.

22. An imaging member in accordance with claim 2 wherein $R_1$ and $R_7$ are phenyl, $R_2$, $R_3$, $R_6$, and $R_8$ are methyl, $R_5$ is cyclohexyl, $R_4$ is propyl, m is 0.33 mole percent, n is 0.33 mole percent, p is 0.28 mole percent, and q is 0.06 mole percent.

23. An imaging member in accordance with claim 2 wherein m is 0.12 mole percent, n is 0.25 mole percent, p is 0.50 mole percent, q is 0.125 mole percent, $R_1$ and $R_7$ are phenyl, $R_2$, $R_3$, $R_6$, and $R_8$ are methyl, $R_5$ is cyclohexyl, and $R_4$ is propyl.

* * * * *